US007461413B2

(12) United States Patent
Lewis et al.

(10) Patent No.: US 7,461,413 B2
(45) Date of Patent: Dec. 9, 2008

(54) URINAL SPLASH GUARD INSERT

(75) Inventors: Michael Lewis, 4335 Marina City Dr., #346 SE., Marina Del Rey, CA (US) 90292; Patrick Sullivan, Newport Beach, CA (US); Jo Dee Jensen Smith, Orange, CA (US)

(73) Assignee: Michael Lewis, Marina Del Rey, CA (US)

( * ) Notice: Subject to any disclaimer, the term of this patent is extended or adjusted under 35 U.S.C. 154(b) by 543 days.

(21) Appl. No.: 10/924,406

(22) Filed: Aug. 23, 2004

(65) Prior Publication Data

US 2006/0037128 A1 Feb. 23, 2006

(51) Int. Cl.
*E03D 9/00* (2006.01)
*F15D 1/00* (2006.01)

(52) U.S. Cl. ..... 4/300.3; 4/DIG. 5

(58) Field of Classification Search ..... 401/300.3, 401/DIG. 5, 311, 310, 902
See application file for complete search history.

(56) References Cited

U.S. PATENT DOCUMENTS 1,442,270 A 1/1923 Hedberg
1,857,328 A 5/1932 Piper
1,879,066 A 9/1932 Bryant
2,407,005 A 9/1946 Haley
2,791,780 A * 5/1957 Krischer ..... 434/247
4,670,918 A 6/1987 Juaire et al.
4,716,602 A 1/1988 Brickhouse
5,044,020 A * 9/1991 Lewandowski et al. ..... 4/301
5,815,851 A 10/1998 Perry
6,357,055 B1 * 3/2002 Gambla et al. ..... 4/300.3
6,408,447 B1 6/2002 Burbank et al.
6,550,075 B1 4/2003 Brannon, III
7,043,773 B2 * 5/2006 McAleenan, Jr. ..... 4/300.3

* cited by examiner

*Primary Examiner*—Huyen Le
(74) *Attorney, Agent, or Firm*—Gene Scott; Patent Law & Venture Group

(57) ABSTRACT

A wall mounted urinal has a detachable urinal insert where the insert provides a frontally directed opening for receiving a urine stream. The insert provides a lower surface in contact with the bottom surface of the urinal for supporting the insert, and an upper surface or a rear surface, or both, for stabilizing the insert within the urinal. A splash capturing surface defines an aperture for admitting a urine stream, the aperture comprising an area inferior to that of the frontally directed opening of the urinal and extending outwardly from it.

11 Claims, 1 Drawing Sheet

URINAL SPLASH GUARD INSERT

RELATED APPLICATIONS

None

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to urinal or toilet deflectors or splash guards and more particularly to an insert for a wall mounted urinal for assuring that splashes and drips are contained within the urinal.

2. Description of Related Art

The following art defines the present state of this field:

Hedberg, U.S. Pat. No. 1,442,270: An improved shield device for toilet bowls and seats comprises a body portion made of flexible, yielding material substantially segmental in outline and designed to be secured to the under surface of a toilet seat at the front thereof, and an apron portion and designed to extend downwardly from the under surface of the seat to a point spaced below the top of the bowl, the forward edge of said apron being beveled to incline downwardly and rearwardly to engage the inner edge of the bowl top, for the purposes stated.

Piper, U.S. Pat. No. 1,854,328: A sanitary shield comprises a clamping member adapted to be placed on the rim of a closet bowl, an apron hinged to said clamping member, a spring on the hinge member for causing the apron to assume an inclined position above the rim of the bowl.

Bryant, U.S. Pat. No. 1,879,066: A shield is adapted for attachment to a boy's toilet seat of the open front type having an opening extending inwardly from its forward edge, said shield comprising a bowl adapted to be seated in said opening with the mouth of said bowl facing rearwardly, and yieldable means on said bowl adapted to frictionally engage the edges of the seat adjacent said opening for detachably securing said bowl to the seat.

Haley, U.S. Pat. No. 24,070,605: A commode attachment comprises a baffle which is arcuate from end to end in plan and which is arcuate in cross section from end to end and whose center is elevated, the ends forming discharge chutes which decline each way from the elevated portion, the forward margin of the baffle being shaped to fit against the inside of the front wall of the commode from end to end and the baffle extending rearwardly beyond the commode rim but only part of the way across the commode bowl so as to leave the rear portion of the bowl unobstructed and means for attaching the baffle to the commode.

Juaire et al, U.S. Pat. No. 4,670,918: A urinal for use with a portable restroom unit is formed of plastic and includes a unitary urinal body, including rear, side, bottom and front walls. Front and rear shelves are integral with front and rear walls, respectively, and cooperate with front and rear locking elements for supporting a screen. Attachment tabs project from the rear and bottom walls to permit attachment of the urinal to a wall of the portable restroom unit. A tubular drain tube is integral with the urinal and includes large and small diameter portions to permit selective connection to large and small diameter drain tubes.

Brickhouse, U.S. Pat. No. 4,716,602: A urination deflector for attachment to a toilet seat is formed using a sheet of flexible plastic material which is provided with hook and loop fastening arrangements which maintain the device to the toilet seat and provide for folding of the device into its functional configuration.

Perry, U.S. Pat. No. 5,815,851: A urinating splash shield for use with conventional toilets which includes a splash shield and radial attachment ring. The splash shield is flipped up for use and down for nonuse. The attachment ring enables the splash shield to seat within the toilet bowl mouth. The device isolates the toilet seat from the urine stream thereby negating any additional need to clean the toilet seat.

Burbank et al, U.S. Pat. No. 6,408,447: A urine deflector is designed to be detachably interconnected with a toilet seat of the type having an upper surface designed to support a user and a hole defined through the seat. The deflector includes a stream deflection member designed to deflect a stream of urine into the toilet bowl. The deflection member has a concave deflection surface. A support member is provided that has a generally planar body designed to be supported on the upper surface of the toilet seat. The generally planar body supports the deflection member such that when the generally planar body is placed on the upper surface of the toilet seat, the deflection member projects into the hole in the seat and the concave deflection surface faces a user seated on the seat. The support member also includes an attachment for releasably retaining the generally planar body in engagement with the upper surface of the seat.

Brannon, III, U.S. Pat. No. 6,550,075: A toilet bowl splash guard prevents splattering about the toilet when the user is going to the bathroom. The toilet bowl splash guard includes a support member being adapted to be attached to an underside of a toilet seat; and also includes an upper sheet of material having a top end which is securely attached to the support member; and further includes a hinge member being attached to a bottom end of the upper sheet of material; and also includes a lower sheet of material being attached to the hinge member and being adapted to extend into a toilet bowl; and further includes side sheets of material being attached to the upper and lower sheets of material to form side walls to prevent splattering to sides of the toilet; and also includes a fastening member for fastening one of the sheets of material to the toilet bowl.

Our prior art search with abstracts described above teaches: a toilet seat front shield, a toilet bowl with hinged shield, a shield for a boys toilet seat, an attachment for toilets, a urinal for use with a portable toilet structure, a urination deflector, a collapsible urinal splash shield, an adult urine splash guard, and a toilet bowl splash guard, but except for Juaire et al, U.S. Pat. No. 4,670,918, the prior art does not address issues concerning conventional wall-mounted urinals. Specifically, the prior art does not appear to address the issues of overspray, leakage, drips and related problems that occur with the use of wall mounted urinals where a male is standing during the act of urination. The present invention fulfills these needs and provides solutions and further related advantages as described in the following summary.

SUMMARY OF THE INVENTION

The present invention teaches certain benefits in construction and use which give rise to the objectives described below. The invention is directed to the well-known problem of urine containment in the use of urinals. Two specific issues arise. First, it is well known that when a urine stream is directed into a urinal, impact with one of the urinal's interior surfaces creates splashes, and these splashes are often not fully contained within the urinal, but may come into contact with the user's clothing or fall to the floor in front of the urinal. Second, the floor in front of a urinal is often found to be wet with urine spillage. Such wetness is not only caused by inadvertent splashing but is primarily caused by dripping. When a man urinates into a urinal the initiation and cessation of the urination stream includes poorly directed stream control and dripping. Older men especially often have a considerable problem with stream control and cessation dripping. This not only creates an odor problem in public toilet facilities, but also a slip-and-fall liability problem to the establishment, and an embarrassment to the person whose clothing becomes wet. The primary reason why commercial urinals do not function more efficiently is that the frontal opening into which the urine stream is directed is too large and the rearwardly directed surface which receives the urine stream is not oriented for deflecting the urine stream downward. The present invention corrects this condition.

A wall mounted urinal has a detachable urinal insert where the insert provides a frontally directed opening for receiving a urine stream. The insert provides a lower surface in contact with the bottom surface of the urinal for supporting the insert, and an upper surface or a rear surface, or both, for stabilizing the insert within the urinal. A splash capturing surface defines an aperture for admitting a urine stream, the aperture comprising an area inferior to that of the frontally directed opening of the urinal and extending outwardly from it.

A primary objective of the present invention is to provide an apparatus and method of use of such apparatus that yields advantages not taught by the prior art.

Another objective is to provide such an invention capable of containing all of the urine ejected by a urinal user.

A further objective is to provide such an invention capable of containing misdirected urine especially during cessation of urination.

A still further objective is to provide such an invention capable of being inserted and engaged within a standard urinal and of being flushed by the urinal's flushing system, and of being drained using the urinal's drainage system.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in several of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the meaning of the present invention in any way.

Figure 1:
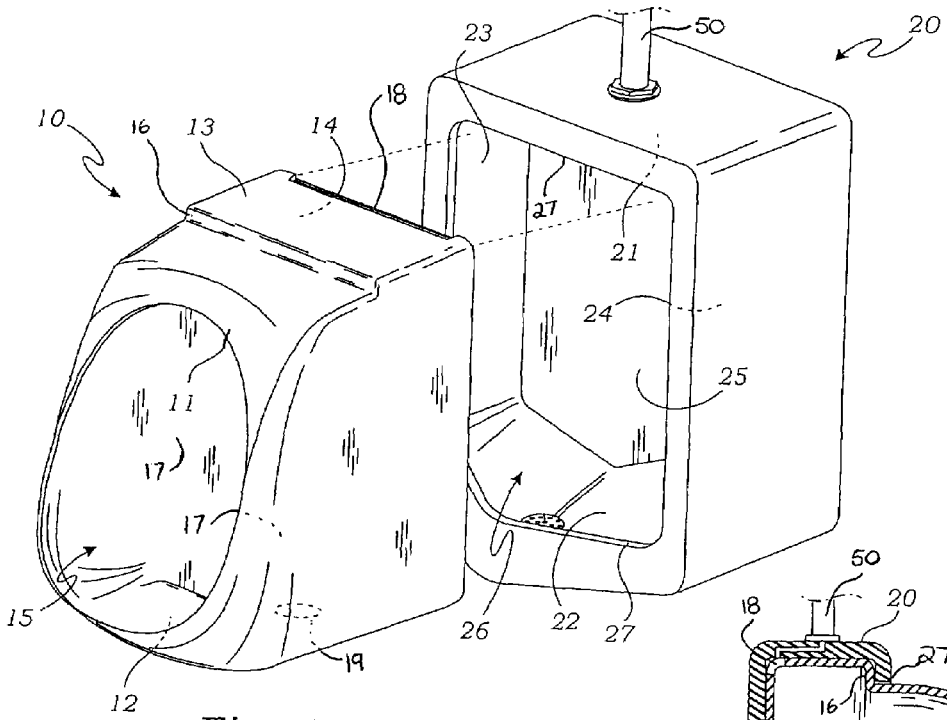
FIG. 1 is an exploded perspective view of the present invention showing a urinal insert and a urinal to which it is mounted.
Figure 3:
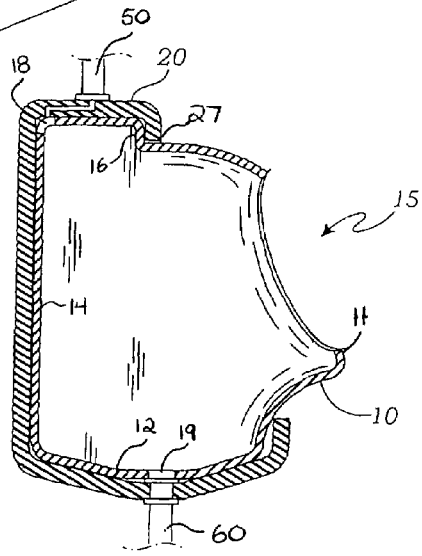
FIG. 3 is vertical sectional view taken along cutting line 3-3 in FIG. 2.
Figure 2:
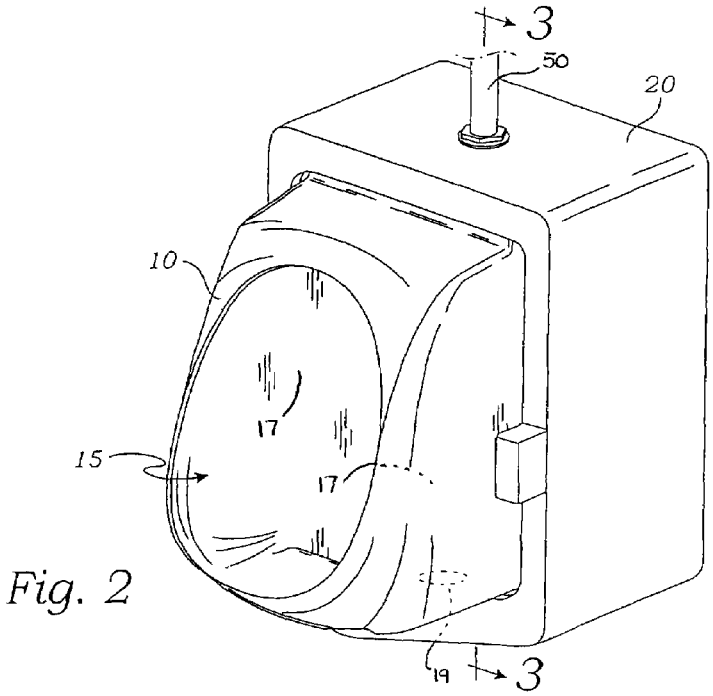
FIG. 2 is a perspective view thereof with the invention mounted on the urinal.

The present invention is a splash and drip guard apparatus or insert 10 designed for detachable insertion into a wall mounted urinal 20, wherein the urinal 20 has a top 21, bottom 22, left 23 and right side 24, urinal lip 27, and rear 25 interior surfaces. Most standard urinals have such construction and this is well known, but FIG. 1 illustrates such a typical urinal 20. The urinal's surfaces 21-24 define a frontally directed opening 26 for accepting a urine stream (not shown) entering the urinal through the frontally directed opening 26. The splash and drip guard apparatus (the insert 10), includes a splash capturing surface 11 extending in part, frontally and exteriorly to the frontally directed opening 26 of the urinal 20, and a lower surface 12 in contact with the bottom surface 22 of the urinal 20 for resting the insert 10 in the urinal 20. It also provides an upper surface 13 contiguous with an insert lip 16 positioned for contact behind the urinal lip 27 in a manner for securing the insert 10 within the urinal 20, as shown in FIG. 3. With insert lip 16 engaged behind the urinal lip 27, the urinal is not able to rotate toward and through the frontally directed opening 26. In one embodiment, the insert 10 may also provide a rear surface 14 for further stabilizing the insert 10 within the urinal 20. The splash capturing surface 11, an interior surface within the insert 10, defines an aperture 15 which is large enough for admitting the urine stream into the insert 10. The aperture 15 comprises an area that is inferior, or smaller, than that of the frontally directed opening 26 of the urinal 20 and therefore is able to prevent backsplash from the interior of the insert 10, and also backsplash from the urinal's rear surface 25 where, in an alternate embodiment, the insert 10 does not provide a rear wall surface 14. In a still further alternate embodiment (not shown), the rear surface 14 is concave thereby presenting a surface that deflects the urine stream downwardly.

As shown in FIGS. 1 and 3, the upper surface 13 of the insert 10 preferably provides at least one rear slot 18 which is positioned for diverting flush water, which enters the urinal 20 through an upper pipe 50, into the insert 10. As shown in FIG. 3, the flush water then exits insert 10 through a drain aperture 19 in lower surface 12, and then through a drain pipe 60.

Clearly, the present invention may. in one embodiment, be considered as the combination of the insert 10 and the urinal 20, as well as, in another embodiment, the insert 10 alone which is configured for engagement with the urinal 20.

An alternative way of describing the present invention as a combination of the insert 10 and urinal 20, with respect to all of the details described above, and in greater particularity and conciseness is as follows. The urinal insert 10 provides rear 14, side 17, top 13, frontal 11 and bottom 12 portions thereby forming a mostly closed structure. The insert 10 also provides a water inlet 18 in the top portion 13, a water outlet 19 in the bottom portion 12, and a urinal stream opening 15 in the frontal portion 11. The top portion 13 further provides a laterally extensive insert lip 16 as best shown in FIG. 3. The insert lip 16 and rear portion 14 of the insert 10 are positioned in such a way so as to create a tight fit between the frontal lip 27 and the rear surface 25 of the urinal 20 when the bottom portion 12 of the insert 10 is resting on the bottom surface 22 of the urinal 20. In this manner the urinal insert 10 is held securely within the urinal and yet provides greater privacy and assurance against urine that might splash against a user or generally out of the insert 10. Language used in this paragraph to describe the present invention differs from terminology used in earlier portions of this description only to better define the parts of the invention and their relationship to each other, and common numerical reference numbers are used both in earlier paragraphs and herein. However, no new language that is not obvious usage for the elements of this invention as described and illustrated has been added.

The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments below or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A splash and drip guard insert apparatus for detachable interconnection with a wall mounted urinal, the urinal having top, bottom, left and right sides, urinal lip, and rear surfaces, the urinal surfaces defining a frontally directed opening for accepting a urine stream entering the urinal through the frontally directed opening, the apparatus comprising: a splash capturing surface extending in part, frontally and exteriorly to the frontally directed opening of the urinal; a lower surface in contact with the bottom surface of the urinal for supporting the insert in the urinal; and an upper surface providing a continguous insert lip configured and positioned on the upper surface so that it is able to be placed behind the urinal lip in a manner for securing the insert within the urinal, the splash capturing surface defining therein an aperture for admitting the urine stream therethrough, the aperture positioned distally from, and comprising an area inferior to that of, the frontally directed opening of the urinal.

2. The apparatus of claim 1 further comprising a rear surface of the insert for stabilizing the insert within the urinal.

3. The apparatus of claim 2 wherein the splash capturing surface and the rear surface of the insert are positioned to be in contact with the rear surface and bottom surface respectively of the urinal for securing the insert within the urinal.

4. The apparatus of claim 2 wherein the upper surface of the insert provides at least one rear slot positioned for receiving flush water into the insert.

5. The apparatus of claim 1 wherein the lower surface of the insert provides a drain aperture positioned for diverting flush water through a drain pipe in the bottom surface of the urinal.

6. A combination apparatus for more sanitary urinating comprising: a wall mounted urinal and a detachable urinal insert, the urinal having top, bottom, left and right sides, urinal lip, and rear surfaces, the urinal surfaces defining a frontally directed opening for accepting a urine stream entering the urinal through the frontally directed opening, the urinal insert providing a splash capturing surface extending in part, frontally and exteriorly to the frontally directed opening of the urinal; the insert further providing a lower surface in contact with the bottom surface of the urinal for supporting the insert in the urinal, and an upper surface providing a contiguous insert lip positioned behind the urinal lip thereby securing the insert within the urinal, the splash capturing surface defining therein an aperture for admitting a urine stream therethrough, the aperture positioned distally from, and comprising an area inferior to that of, the frontally directed opening of the urinal.

7. The apparatus of claim 6 further comprising a rear surface of the insert abutting the rear surface of the urinal.

8. The apparatus of claim 7 wherein the splash capturing surface and the rear surface of the insert are positioned in contact with the rear surface and bottom surface respectively of the urinal for securing the insert within the urinal.

9. The apparatus of claim 7 wherein the upper surface of the insert provides at least one rear slot positioned for receiving flush water into the insert.

10. The apparatus of claim 6 wherein the lower surface of the insert provides a drain aperture positioned for diverting flush water through a drain pipe in the bottom surface of the urinal.

11. A combination urinal and urinal insert apparatus comprising: the urinal insert providing rear, side, top, frontal and bottom portions forming a mostly closed structure having a water inlet in said top portion, a water outlet in said bottom portion and a urinal stream opening in said frontal portion; the top portion providing a vertical lip laterally extensive thereon; the vertical lip and rear portion of the urinal insert tight fitting between a urinal lip and a rear surface of the urinal when the bottom portion of the insert is resting on a bottom surface of the urinal.

* * * * *